US006035151A

United States Patent [19]

Ono et al.

[11] Patent Number: 6,035,151

[45] Date of Patent: Mar. 7, 2000

[54] IMAGE FORMING SYSTEM AND CONTROL METHOD THEREOF

[75] Inventors: Akinori Ono; Toshihiko Mitsuhashi; Kanou Saitou, all of Saitama, Japan

[73] Assignee: Fuji Xerox Co., Ltd., Tokyo, Japan

[21] Appl. No.: 09/213,374

[22] Filed: Dec. 17, 1998

[30] Foreign Application Priority Data

Dec. 19, 1997 [JP] Japan ..... 9-351332

[51] Int. Cl.[7] ..... G03G 15/00; G03G 15/16

[52] U.S. Cl. ..... 399/43; 399/66; 430/126

[58] Field of Search ..... 399/66, 43, 44, 399/45, 16, 76, 77, 314, 388; 430/126

[56] References Cited

U.S. PATENT DOCUMENTS

| | | | |
|---|---|---|---|
| 5,717,980 | 2/1998 | Oka et al. | 399/66 |
| 5,761,568 | 6/1998 | Haragakiuchi et al. | 399/44 |
| 5,887,220 | 3/1999 | Nagaoka | 399/43 X |
| 5,903,798 | 5/1999 | Yokogawa et al. | 399/66 |

FOREIGN PATENT DOCUMENTS

| | | |
|---|---|---|
| 3-157681 | 7/1991 | Japan . |
| 5-297740 | 11/1993 | Japan . |

*Primary Examiner*—Sophia S. Chen

*Attorney, Agent, or Firm*—Finnegan, Henderson, Farabow, Garrett & Dunner, L.L.P.

[57] ABSTRACT

An image forming system wherein a predetermined monitor signal is applied to a transfer roll for estimating a resistance value of the transfer roll between one sheet of recording paper passing through the contact portion between a photosensitive drum and the transfer roll and the next sheet of recording paper being introduced into the contact portion and the transfer bias applied to the transfer roll is updated in response to the estimated resistance value. In the image forming system, if the time between one sheet of recording paper passing through the contact portion and the next sheet of recording paper being introduced into the contact portion is less than a predetermined time, updating of the transfer bias is inhibited, and further if updating of the transfer bias is inhibited successively a predetermined threshold value of the number of times or more, introduction of the next sheet of recording paper is delayed a predetermined time.

34 Claims, 12 Drawing Sheets

IMAGE FORMING SYSTEM AND CONTROL METHOD THEREOF

BACKGROUND OF THE INVENTION

1. Field of the Invention

This invention relates to an image forming system and a control method thereof and in particular, to an image forming system for developing an electrostatic latent image formed on a photo sensitive body of an electrophotographic copier, a facsimile, a laser printer, or the like, with toner and transferring the toner image to recording paper by applying a voltage to a transfer roll wherein a high-quality image can be formed by appropriately controlling a transfer bias applied to the transfer roll, and a control method of the image forming system.

2. Description of the Related Art

Hitherto, an electrophotographic copier, a facsimile, a laser printer, and the like have been known as an image forming system which comprises an image carrier such as a photosensitive drum and transfer means such as a transfer roll for pressing against the image carrier, makes a transfer material pass through the space between the image carrier and the transfer roll pressing there against, and at this time, applies a transfer bias to the transfer means for transferring a toner image on the image carrier to the transfer material such as recording paper.

In the image forming systems, a configuration for applying a constant current or a constant voltage to a transfer roll which is transfer means just before print, estimating a resistance value of the transfer roll from the current or voltage value at that time, which will be hereinafter referred to as BTR resistance monitor, and controlling the transfer bias applied to the transfer roll which is the transfer means to the optimum value based on the BTR resistance monitor is proposed, for example, as disclosed in Japanese Patent Unexamined Publication Nos. Hei. 3-157681 and Hei. 5-297740.

The BTR resistance monitor is configured so as to determine the optimum transfer bias applied to the transfer roll using a table provided for storing the optimum transfer bias corresponding to current value A, for example, if the current value A is measured when a constant voltage is applied to the transfer roll.

By the way, generally, urethane foam is used as the transfer roll material and an ionic conductive agent is contained in the urethane foam, thereby providing conductive performance or carbon particles are dispersed in the urethane foam, thereby providing conductive performance.

Particularly, the resistance value of the transfer roll of the type wherein an ionic conductive agent is contained, which will be hereinafter referred to as ion transfer roll, changes in the order of $10^6$ to $10^{10}$ between a high-temperature environment (28° C./85% RH) and a low-temperature environment (10° C./15% RH).

Therefore, for example, when such a transfer roll is used and constant voltage control is performed for transferring an image, to obtain an appropriate transfer current voltage, it is necessary to apply a constant current or voltage to the transfer roll just before print, estimate the resistance value of the transfer roll, which will be hereinafter referred to as BTR resistance, from the current or voltage value at that time, and determine the optimum transfer bias.

To use the ion transfer roll for continuous print, the BTR resistance largely changes due to a BTR resistance energization rise or an in-machine temperature rise caused by heat from a fuser, or the like.

To cope with such a case, a configuration for applying a constant current or voltage to the transfer roll at the non-print time between pages in continuous print, estimating the BTR resistance from the current or voltage value at that time, and determining a proper transfer bias to the transfer roll based on the estimated resistance value is also proposed as disclosed in Japanese Patent Unexamined Publication Nos. Hei. 3-157681 and Hei. 5-297740.

Recording paper just after fusing is high in resistance and low in moisture content. Thus, in second-side transfer (rear-side print) at the double-sided print time, transfer image quality failure such as transfer memory or toner scatter easily occurs and the proper transfer bias range is narrow.

Therefore, the voltage latitude of transfer bias is narrow for one BTR resistance and fine control becomes necessary. For example, if a difference between the BTR resistance estimated by the BTR resistance monitor and the actual BTR resistance is large, transfer image quality failure occurs and its occurrence level becomes terrible.

The BTR resistance of the ion transfer roll depends largely on the environment; for example, in a high-temperature, high-humidity environment (28° C./85% RH), the resistance value at the 1000-V applying time is about $1.0\times10^7$ ohms and in a low-temperature, low-humidity environment (10° C./15% RH), the BTR resistance rises to about $1.0\times10^9$ ohms.

If an attempt is made to perform constant current control of the BTR resistance of the transfer roll having such characteristics with one constant current value and estimate the BTR resistance from the voltage value at that time, voltage value change with BTR resistance change becomes large in the low-temperature, low-humidity environment and becomes small in the high-temperature, high-humidity environment; the BTR resistance estimating accuracy becomes low in the high-temperature, high-humidity environment.

In contrast, if an attempt is made to perform constant voltage control of the BTR resistance with one constant voltage value and estimate the BTR resistance from the current value at that time, voltage value change with BTR resistance change becomes large in the high-temperature, high-humidity environment and becomes small in the low-temperature, low-humidity environment; the BTR resistance estimating accuracy becomes low in the low-temperature, low-humidity environment.

To solve such a problem, for example, a configuration for applying a constant voltage or current at least two times each in a different value and estimating the current-voltage characteristic of the BTR resistance at that time, and determining the optimum transfer voltage based on the estimation is also proposed as disclosed in Japanese Patent Unexamined Publication No. Hei. 3-157681.

Recording paper after second-side transfer, which undergoes twice transfer and once fusing, is strongly charged and curls after the fusing. Therefore, the recording paper after the second-side transfer is easily attracted to the image carrier electrostatically and mechanically, and a peel failure from the image carrier after transfer easily occurs particularly in a high-temperature, high-humidity environment.

By the way, in recent years, with faster desktop laser printers, the laser printers have been provided each with a large-capacity recording paper tray or the paper feed speed has been made higher (process speed 90 mm/sec or more) for enhancing productivity. Further, means for narrowing the non-print timing between one print and the next or the like has been used for enhancing productivity of the laser printers. Thus, sufficient BTR resistance monitor time between pages may not be taken.

Furthermore, the paper feed speed varies depending on the recording paper type. To use recording paper with large transport resistance, the transport speed of the recording paper is slow as compared with that of any other recording paper. At this time, if the recording paper is passing through a transfer nip portion at the timing of applying a transfer bias of a constant voltage or current to estimate the transfer roll resistance between pages, the BTR resistance cannot correctly be estimated. If the BTR resistance cannot correctly be estimated, the optimum transfer bias cannot be applied, causing transfer image quality trouble to occur.

SUMMARY OF THE INVENTION

It is therefore an object of the invention to provide an image forming system that can properly control a transfer bias based on estimation of the resistance value of transfer means for forming a high-quality image and a control method of the image forming system.

To the end, according to the invention, there is provided an image forming system having an image carrier for carrying a transfer image and transfer means to which a predetermined transfer bias is applied for sequentially introducing a transfer material into a contact portion between the image carrier and the transfer means and allowing the transfer material to pass therethrough, thereby sequentially transferring the transfer image to the transfer material, wherein a predetermined monitor signal is applied to the transfer means for estimating a resistance value of the transfer means between one transfer material passing through the contact portion and a next transfer material being introduced into the contact portion and the transfer bias is updated in response to the estimated resistance value, the image forming system comprising: transfer bias control means for inhibiting updating of the transfer bias if a time between the one transfer material passing through the contact portion and the next transfer material being introduced into the contact portion is less than a predetermined time.

Further, according to the invention, there is provided an image forming system having an image carrier for carrying a transfer image and transfer means to which a predetermined transfer bias is applied for sequentially introducing a transfer material into a contact portion between the image carrier and the transfer means and allowing the transfer material to pass therethrough, thereby sequentially transferring the transfer image to the transfer material, wherein a predetermined monitor signal is applied to the transfer means for estimating resistance value of the transfer means between one transfer material passing through the contact portion and a next transfer material being introduced into the contact portion and the transfer bias is updated in response to the estimated resistance value, the image forming system comprising: transfer bias control means for inhibiting updating of the transfer bias if a time between the one transfer material passing through the contact portion and the next transfer material being introduced into the contact portion is less than a predetermined time; and delay means for delaying introduction of the next transfer material a predetermined time if the transfer bias control means successively inhibits updating of the transfer bias a predetermined threshold value of the number of times or more.

Further, according to the invention, there is provided an image forming system having an image carrier for carrying a transfer image and transfer means to which a predetermined transfer bias is applied for sequentially introducing a transfer material into a contact portion between the image carrier and the transfer means and allowing the transfer material to pass therethrough, thereby sequentially transferring the transfer image to the transfer material, wherein a predetermined monitor signal is applied to the transfer means for estimating a resistance value of the transfer means between one transfer material passing through the contact portion and a next transfer material being introduced into the contact portion and the transfer bias is updated in response to the estimated resistance value, the image forming system comprising: transfer bias control means for inhibiting updating of the transfer bias if a time between the one transfer material passing through the contact portion and the next transfer material being introduced into the contact portion is less than a predetermined time; and delay means for delaying introduction of the next transfer material until the image carrier makes at least one round if the estimated resistance value of the transfer means is equal to or less than a preset value.

Further, according to the invention, there is provided a method for controlling an image forming system having an image carrier for carrying a transfer image and transfer means to which a predetermined transfer bias is applied for sequentially introducing a transfer material into a contact portion between the image carrier and the transfer means and allowing the transfer material to pass therethrough, thereby sequentially transferring the transfer image to the transfer material, the method comprising the steps of: applying a predetermined monitor signal to the transfer means for estimating a resistance value of the transfer means between one transfer material passing through the contact portion and a next transfer material being introduced into the contact portion; updating the transfer bias in response to the estimated resistance value; and inhibiting updating of the transfer bias if a time between the one transfer material passing through the contact portion and the next transfer material being introduced into the contact portion is less than a predetermined time.

Further, according to the invention, there is provided a method for controlling an image forming system having an image carrier for carrying a transfer image and transfer means to which a predetermined transfer bias is applied for sequentially introducing a transfer material into a contact portion between the image carrier and the transfer means and allowing the transfer material to pass therethrough, thereby sequentially transferring the transfer image to the transfer material, the method comprising the steps of: applying a predetermined monitor signal to the transfer means for estimating a resistance value of the transfer means between one transfer material passing through the contact portion and a next transfer material being introduced into the contact portion; updating the transfer bias in response to the estimated resistance value; inhibiting updating of the transfer bias if a time between the one transfer material passing through the contact portion and the next transfer material being introduced into the contact portion is less than a predetermined time; and delaying introduction of the next transfer material a predetermined time if updating of the transfer bias has been inhibited successively a predetermined threshold value of the number of times or more.

Further, according to the invention, there is provided a method for controlling an image forming system having an image carrier for carrying a transfer image and transfer means to which a predetermined transfer bias is applied for sequentially introducing a transfer material into a contact portion between the image carrier and the transfer means and allowing the transfer material to pass therethrough, thereby sequentially transferring the transfer image to the transfer material, the method comprising the steps of: applying a predetermined monitor signal to the transfer means for estimating a resistance value of the transfer means between one transfer material passing through the contact portion and a next transfer material being introduced into the contact portion; updating the transfer bias in response to the estimated resistance value; inhibiting updating of the transfer bias if a time between the one transfer material passing through the contact portion and the next transfer material being introduced into the contact portion is less than a predetermined time; and delaying introduction of the next transfer material until the image carrier makes at least one round if the estimated resistance value of the transfer means is equal to or less than a preset value.

DETAILED DESCRIPTION OF THE PREFERRED EMBODIMENTS

Referring now to the accompanying drawings, there is shown one preferred embodiment of an image forming system and its control method according to the invention.

Figure 1:
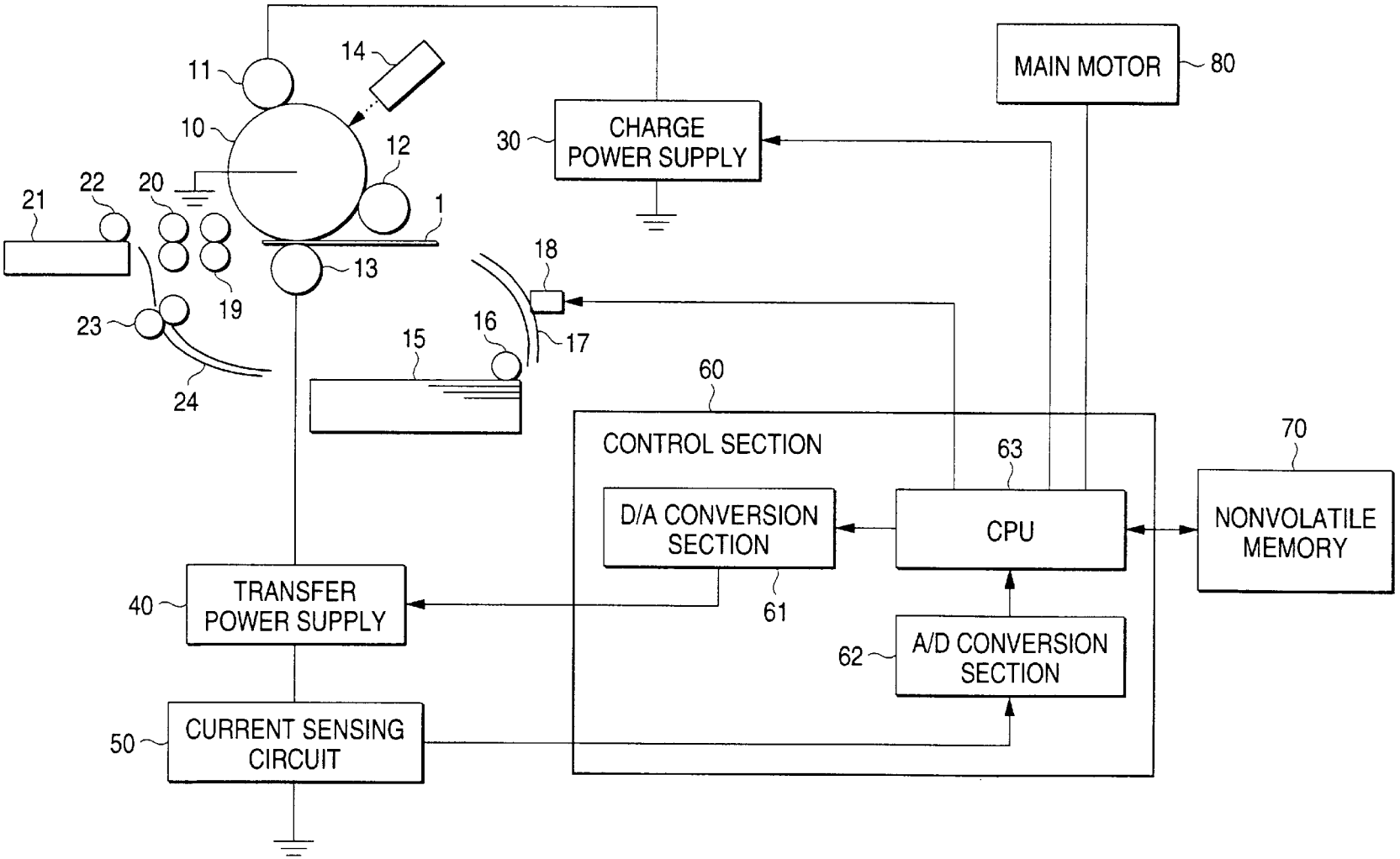
FIG. 1 is a block diagram to show one embodiment of an image forming system incorporating an image forming system and its control method according to the invention.

FIG. 1 is a block diagram to show one embodiment of an image forming system incorporating the image forming system and its control method according to the invention.

The image forming system shown in FIG. 1 comprises a photosensitive drum 10 which is an image carrier and a transfer roll 13 of transfer means for pressing against the photosensitive drum 10, makes recording paper (simply, paper) 1 which is a transfer material pass through the space between the photosensitive drum 10 and the transfer roll 13 pressing there against, and at this time, applies a predetermined transfer bias to the transfer roll 13 for transferring a toner image on the photosensitive drum 10 to the paper 1. The image forming system can be formed of an electrophotographic copier, a facsimile, a laser printer, or the like.

In FIG. 1, generally an organic photosensitive body is used as the photosensitive drum 10. The photosensitive drum 10 rotates at linear velocity of 10–300 mm/sec in the arrow direction in the figure. A roll charger (BCR) 11 pressed against the photosensitive drum 10 and rotating with rotation thereof is disposed on the photosensitive drum 10. A predetermined voltage is applied to the BCR 11 from a charge power supply 30 via a metal mandrel (not shown).

Here, AC voltage 500 V to 2000 V superposed on DC voltage −300 V to −700 V is applied to the BCR 11.

The surface of the photosensitive drum 10 charged by the BCR 11 is exposed by an exposure device 14 and an electrostatic latent image is formed. The electrostatic latent image formed on the surface of the photosensitive drum 10 is further developed by a developing device 12 and a toner image is formed on the surface of the photosensitive drum 10.

On the other hand, the paper 1 transported from a paper tray 15 by a feed roller 16 is fed into a transfer nip portion which is a contact between the photosensitive drum 10 and the transfer roll (BTR) 13 via a paper passage 17.

A paper sensor (REG sensor) 18 is attached to the paper passage 17 between the paper tray 15 and the transfer nip portion for monitoring the time such as the feeding-out timing of the paper 1.

A transfer bias of about 100 V to 6000 V is applied to the paper 1 fed into the transfer nip portion between the photosensitive drum 10 and the BTR 13 from a transfer power supply 40 in response to the resistance value of the BTR 13. The toner image on the photosensitive drum 10 is transferred to the paper 1 by the effect of the transfer bias and the pressing force of the paper 1 against the photosensitive drum 10 by the BTR 13.

The paper 1 to which the toner image on the photosensitive drum 10 has been transferred is fed into a fuser 19 for fusing or fixing the toner image transferred to the paper 1 onto the paper 1 by heat and pressure.

The paper 1 with the toner image fixed thereon by the fuser 19 is discharged onto a paper discharge tray 21 through a paper feed roller 20.

If print on both sides of the paper 1 is executed, namely, print on the second side (rear side of the paper 1) is also executed in addition to that on the first side (front side of the paper 1), the paper 1 with the toner image fixed on the first side and discharged onto the paper discharge tray 21 is fed into a paper transport passage 24 by reversing rotation of a feed roller 22 of the paper discharge tray 21 and is again fed into the feed roll 16 by a paper feed roller 23, then an image. is also printed on the second side through an image forming cycle similar to that described above.

The charge power supply 30 for applying a charge voltage to the roll charger 11 and the transfer power supply 40 for applying a transfer bias to the BTR 13 are controlled by a control section 60 described later in detail, and the drive system of the image forming system including the photosensitive drum 10, the feed roller 16, and the like, which will not be discussed in detail, is driven by a main motor 80 controlled by the control section 60.

The process speed of the image forming system is, for example, 90 mm/sec and the charge potential of the photosensitive drum 10 by the BCR 11 is −500 V. The volume resistance of the used BTR 13 is about $1.0\times10^8$ ohms in a normal-temperature, normal-humidity environment (22° C./55% RH).

In the image forming system, a constant current is applied to the BTR 13 after rotation of the photosensitive drum 10 is started. The current value of the constant current is fixed to 3.5 $\mu$A. For the constant current, the optimum current value should be determined depending on the process speed, but generally a current value in the range of about 2 $\mu$A to 10 $\mu$A is selected.

The BTR resistance is estimated from the voltage value of the BTR 13 at that time. The transfer voltage corresponding to the estimated BTR resistance is selected, whereby the transfer bias applied to the BTR 13 is determined. If peel voltage is also controlled at the same time, it is selected.

The selected values are output from the control section 60 at the print time. Of course, the values at the first-side transfer time and those at the second-side transfer time can be determined separately.

After this, if the print is continued, after the trailing end of the paper 1 passes through the transfer nip portion, further the constant current or voltage, which will be hereinafter referred to as resistance monitor signal, is applied to the BTR 13 and the transfer voltage and the peel voltage are determined through a process similar to that as described above from the estimated value of the BTR resistance at that time, then the values are output from the control section 60 at the print time.

The applying timing of the resistance monitor signal to the BTR 13 is set before the timing at which the paper 1 arrives at the transfer nip portion considering the paper transport distance and process speed after the leading end of the paper 1 passed through the REG sensor 18, or is set after the trailing end of the paper 1 passes through the transfer nip portion.

By the way, the transport speed of the paper 1 varies depending on the transport resistance of the paper transport passage 17, which becomes large or small due to the thickness, weight, etc., of the paper 1.

Since the transport speed of the paper 1 thus varies, the time between the paper 1 being fed out from the paper tray 15 and the leading end of the paper 1 arriving at the transfer nip portion and the time taken for the trailing end of the paper 1 to exit from the transfer nip portion vary.

Thus, the paper 1 may exist in the transfer nip portion at the timing at which the constant current or voltage to estimate the BTR resistance is applied to the BTR 13.

Whether or not the paper 1 exists in the transfer nip portion at the resistance monitor signal applying timing cannot be determined by the REG sensor 18 alone. However, the page-to-page time can be measured by the REG sensor 18. The feeding-out timing of the paper 1 from the paper tray 15 is constant. Thus, if the page-to-page time is a given value or less, it is assumed that the trailing end of the paper 1 passed through the REG sensor 18 with a delay or that the leading end of the paper 1 arrived at the REG sensor 18 early, and it is determined that the paper 1 will exist in the transfer nip portion at the resistance monitor signal applying time.

Then, in the image forming system of the embodiment, if it is feared that the paper 1 may exist in the transfer nip portion at the resistance monitor signal applying time, the resistance monitor signal is not applied to the BTR 13 or the estimation value of the BTR resistance based on the resistance monitor signal is canceled and the transfer bias determined at the immediately preceding transfer time in the mode or transfer bias estimated therefrom is applied.

In the configuration shown in FIG. 1, estimation of the BTR resistance when the resistance monitor signal is applied to the BTR 13 is executed by operation processing of the control section 60 based on detection output of a current sensing circuit 50.

The control section 60 comprises a D/A conversion section 61 for converting the transfer bias processed by a central processing unit (CPU) 63 from digital form into analog form and outputting the conversion result to the transfer power supply 40, an A/D conversion section 62 for converting the detection output of the current sensing circuit 50 from analog form into digital form and outputting the conversion result to the CPU 63, and the above-mentioned CPU 63 for performing transferbias control, etc., according to the invention.

To estimate the BTR resistance, the CPU 63 outputs a predetermined resistance monitor signal to the transfer power supply 40 through the D/A conversion section 61 and reads the detection output of the current sensing circuit 50 at that time through the A/D conversion section 62.

The CPU 63 estimates the BTR resistance, for example, based on a plurality of sample values. Thus, to precisely estimate the BTR resistance between pages at the continuous print time, it is required that a predetermined interval or more be placed between the pages.

Then, in the embodiment, the CPU 63 reads the detection output of the REG sensor 18 and estimates the BTR resistance and determines the transfer bias based on the BTR resistance estimation, namely, performs transfer bias update processing on condition that a predetermined interval or more be placed between the pages based on the detection output of the REG sensor 18.

Figure 2:
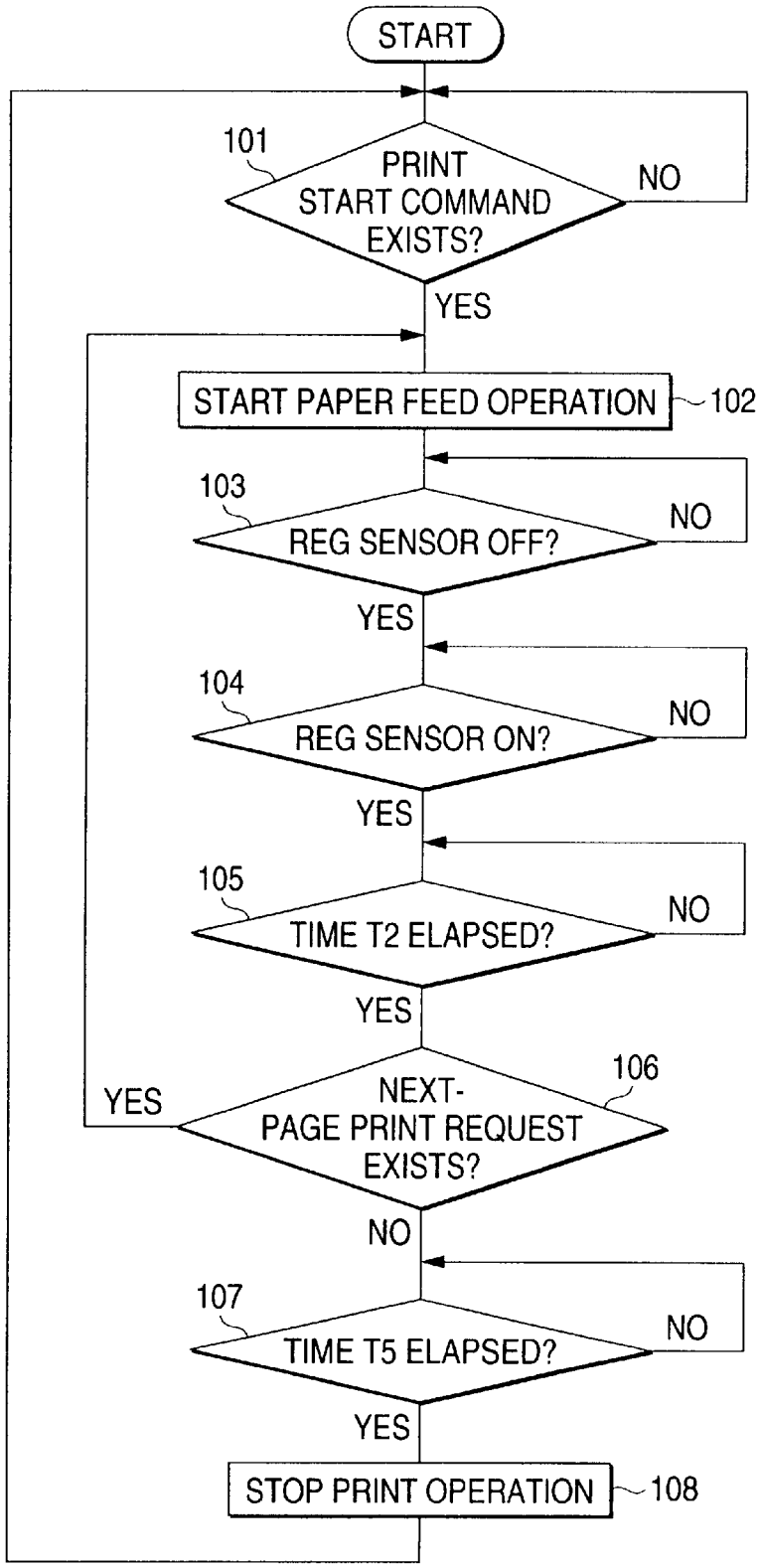
FIG. 2 is a flowchart to show paper feed processing in detail in the image forming system shown in FIG. 1.

FIG. 2 is a flowchart to show paper feed processing in detail in the image forming system shown in FIG. 1.

The CPU 63 first checks whether or not a print start command exists at step 101. If no print start command exists at step 101, the CPU 63 waits until it is determined at step 101 that a print start command exists.

If it is determined at step 101 that a print start command exists, the paper feed operation for transporting a sheet of paper using the feed roller 16 from the paper tray 15 is started at step 102.

Next, if the preceding paper exists, at step 103, a check is made to see if the REG sensor 18 is off as the trailing end of the paper passes through the REG sensor 18. If the REG sensor 18 is not off (NO at step 103), a wait is made at step 103 until the REG sensor 18 changes to off. If it is determined at step 103 that the REG sensor 18 is off, then whether or not the REG sensor 18 is on is checked at step 104.

If the following paper does not arrive at the REG sensor 18 and the REG sensor 18 does not change to on (NO at step 104), a wait is made at step 104 until the REG sensor 18 changes to on. If it is determined that the following paper arrives at the REG sensor 18 and the REG sensor 18 is on (YES at step 104), then whether or not time T2 has elapsed since the REG sensor 18 changed to on is checked at step 105. If the time T2 has not yet elapsed (NO at step 105), a wait is made at step 105 until the time T2 elapses.

If it is determined at step 105 that the time T2 has elapsed, then whether or not a next-page print request exists is checked at step 106. If a next-page print request exists (YES at step 106), control returns to step 102 and the process at step 102 to step 106 is repeated until it is determined at step 106 that no next-page print request exists.

According to the processing, transport of paper from the paper tray 15 at predetermined intervals is accomplished.

If it is determined at step 106 that no next-page print request exists, then whether or not time T5 has further elapsed since the time T2 elapsed is checked at step 107. If the time T5 has not yet elapsed (NO at step 107), a wait is made at step 107 until the time T5 elapses. If it is determined at step 107 that the time T5 has elapsed, the main motor 80 is stopped for stopping the print operation at step 108 and control returns to step 101, entering a standby state for waiting for a new print command.

Figure 3:
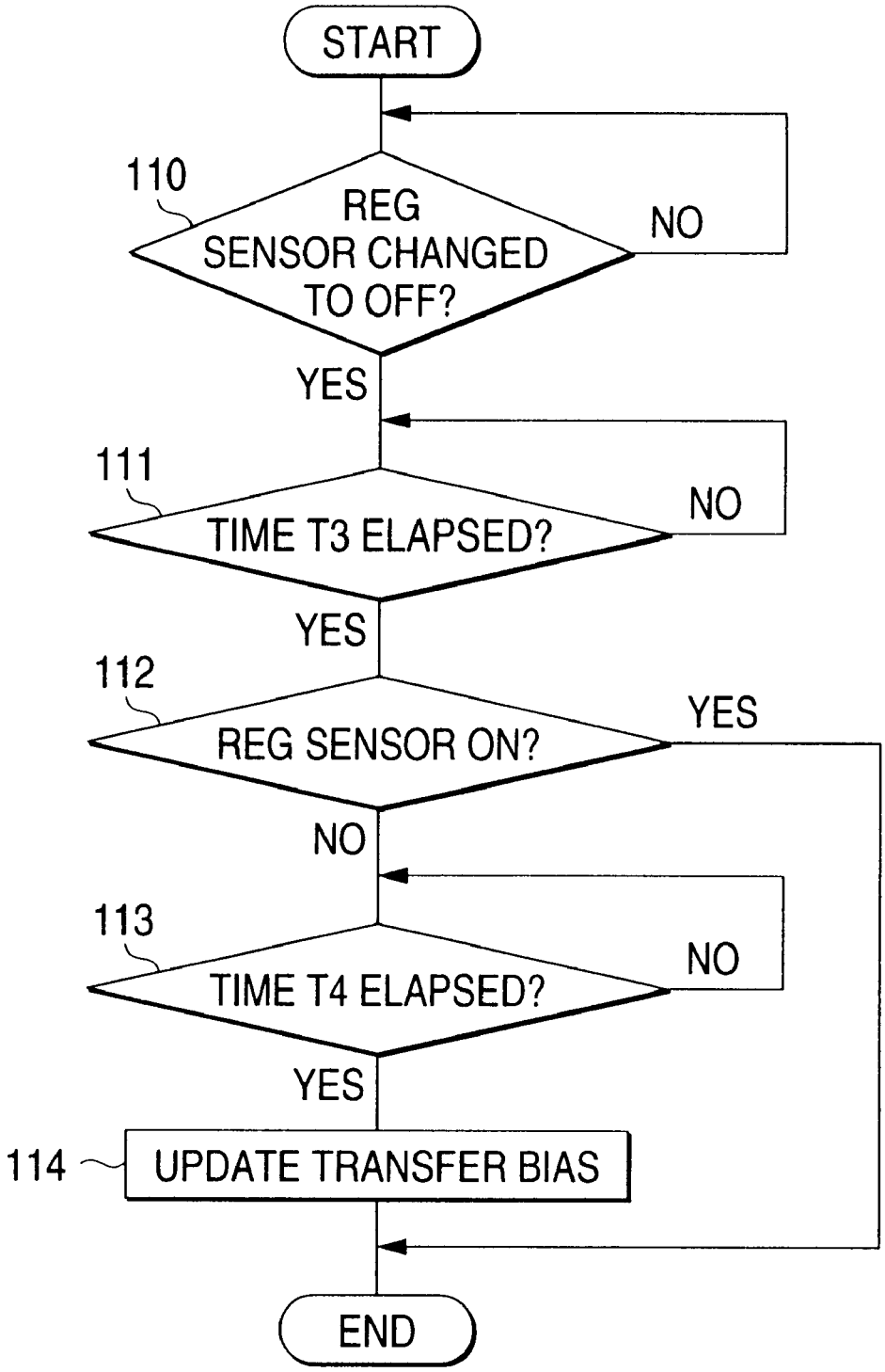
FIG. 3 is a flowchart to show transfer bias update processing in detail in the image forming system shown in FIG. 1.

In the embodiment, in addition to the above processing sequence, transfer bias update processing is performed as described in detail below:

FIG. 3 is a flowchart to show the transfer bias update processing in detail.

In the transfer bias update processing, first whether or not the REG sensor 18 changes from on to off is checked at step 110. If the REG sensor 18 does not change to off (NO at step 110), a wait is made at step 110 for the REG sensor 18 to change from on to off.

If it is determined at step 110 that the REG sensor 18 changes from on to off, then whether or not time T3 has elapsed since the REG sensor 18 changed to off is checked at step 111.

If the time T3 has not yet elapsed (NO at step 111), a wait is made at step 111 until the time T3 elapses. If it is determined at step 111 that the time T3 has elapsed, control goes to step 112 at which whether or not the REG sensor 18 is on at that time is checked. If it is determined at step 112 that the REG sensor 18 is not on, it can be determined that the leading end of the following paper has not arrived at the placement position of the REG sensor 18. Then, whether or not time T4 has further elapsed since the time T3 elapsed is checked at step 113.

If the time T4 has not yet elapsed (NO at step 113), a wait is made at step 113 until the time T4 elapses. If it is determined at step 113 that the time T4 has elapsed, the transfer bias is updated at step 114 and the processing is terminated.

That is, the time T3 is the time required for applying a resistance monitor signal to the BTR 13 between pages and estimating the BTR resistance and if the REG sensor 18 is not on when the time T3 has elapsed since the REG sensor 18 changed to off, it can be determined that the leading end of the following paper has not arrived at the placement position of the REG sensor 18. Thus, in this case, the enough time to estimate the BTR resistance can be ensured. The transfer bias is updated after the time T4 has further elapsed since the time T3 elapsed, namely, in the state in which the trailing end of the preceding paper passes through the transfer nip portion between the photosensitive drum 10 and the BTR 13 and no paper exists in the transfer nip portion before the leading end of the following paper arrives at the transfer nip portion.

Specifically, the transfer bias is updated at step 114 as follows: As described above, the CPU 63 outputs a predetermined resistance monitor signal to the transfer power supply 40 through the D/A conversion section 61 and reads the detection output of the current sensing circuit 50 at that time through the A/D conversion section 62, thereby estimating the BTR resistance, then determines the optimum transfer bias for the estimated BTR resistance based thereon and applies the determined transfer bias as a new transfer bias to the transfer power supply 40 through the D/A conversion section 61, thereby updating the transfer bias.

To determine the optimum transfer bias for the estimated BTR resistance, for example, a table for storing the relationship between the BTR resistance and the optimum transfer bias corresponding thereto is provided and the optimum transfer bias can be determined based on the table.

If it is determined at step 112 that the REG sensor 18 is on when the time T3 has elapsed, the enough time to estimate the BTR resistance cannot be ensured. Then, the transfer bias update processing is terminated without updating the transfer bias at step 114.

In this case, the unupdated transfer bias is held and the CPU 63 applies this transfer bias to the transfer power supply 40 through the D/A conversion section 61.

Figure 4:
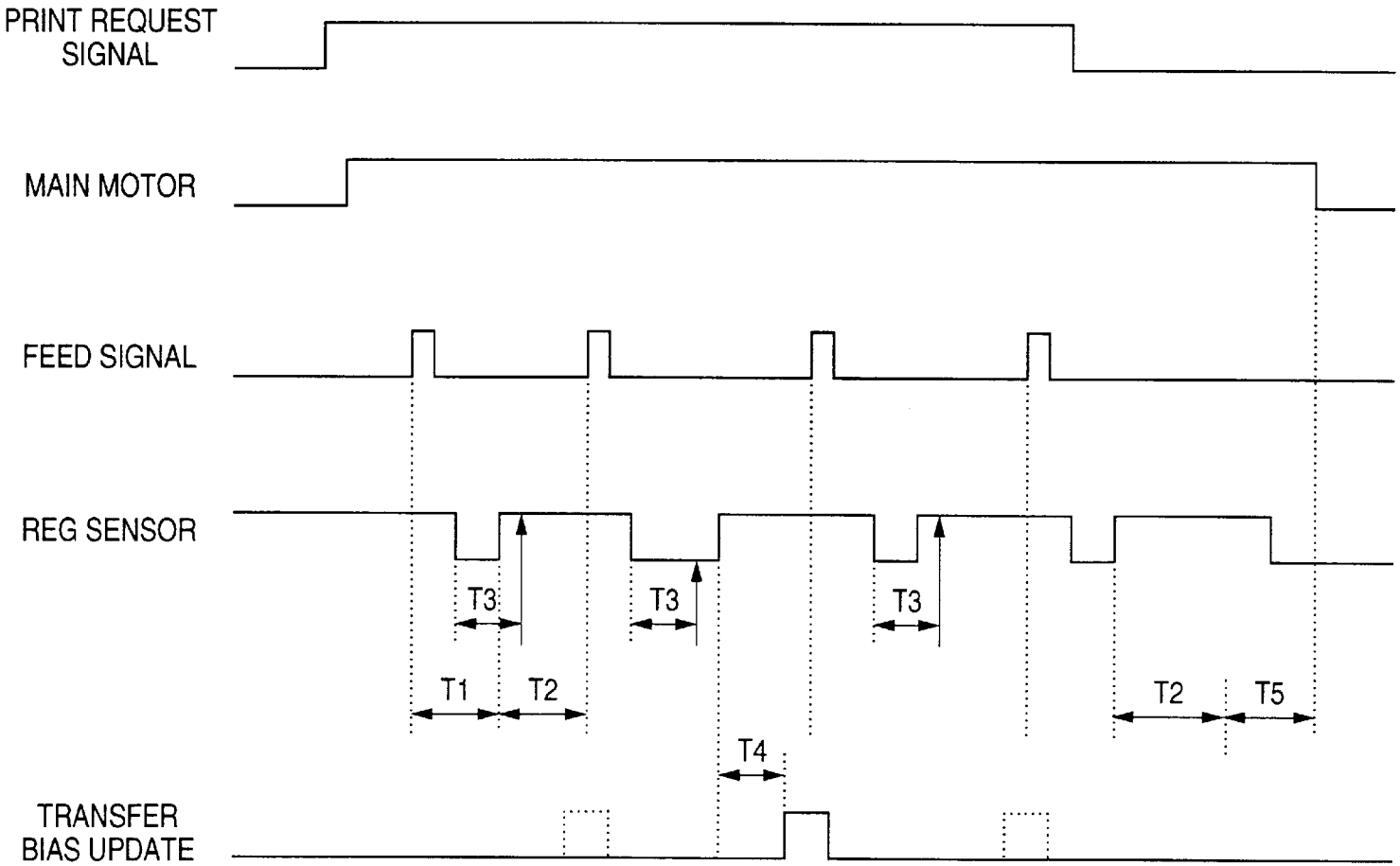
FIG. 4 is a timing chart to show the transfer bias update processing executed in the image forming system shown in FIG. 1 based on the processings shown in FIGS. 2 and 3.

FIG. 4 is a timing chart to show the transfer bias update processing executed in the image forming system shown in FIG. 1 based on the processings shown in FIGS. 2 and 3.

In FIG. 4, when a print request signal goes on, the main motor 80 is turned on. If an error such as a paper jam or the like does not occur and a predetermined interval is placed from the preceding paper, a feed signal is generated for transporting a sheet of paper using the feed roller 16 from the paper tray 15.

The feed roller 16 is provided with a clutch and rotates only when the feed signal is on. As the feed roller 16 rotates, transport of paper is started and the paper arrives at the REG sensor 18 in the time T1 after the feed start. The REG sensor 18 is installed to sense a paper jam or the like and synchronize with the timing of the image forming section.

If the print request signal is on in the time T2 after the REG sensor 18 is turned on, transport of the next paper is started. The REG sensor 18 is checked for state after the time T3 has elapsed since the REG sensor 18 changed from on to off.

If the REG sensor 18 is on, the following paper has already arrived at the REG sensor 18, thus it can be determined that the page interval is a given value or less. In this case, the possibility that paper may exist in the transfer nip portion at the resistance monitor signal applying timing is large, thus the transfer bias is not updated, namely, applying a resistance monitor signal to the BTR 13 for monitoring the BTR resistance is not executed and the transfer bias determined at the immediately preceding transfer time is adopted.

In contrast, if the REG sensor 18 is off when the time T3 has elapsed since the REG sensor 18 changed to off, the following paper has not yet arrived at the REG sensor 18, thus it can be determined that a given or more page interval is ensured. In this case, the transfer bias is updated, namely, resistance monitor processing is performed in the time T4 and the transfer bias provided by monitoring the resistance is adopted at the next print.

In the embodiment, if a given or more page interval is not ensured, the transfer bias is not updated and the transfer bias determined at the immediately preceding transfer time is adopted. Alternatively, if a given or more page interval is not ensured, the transfer bias to be updated may be predicted from the past transfer bias update history and the transfer bias may be updated based on the predicted transfer bias.

Figure 5:
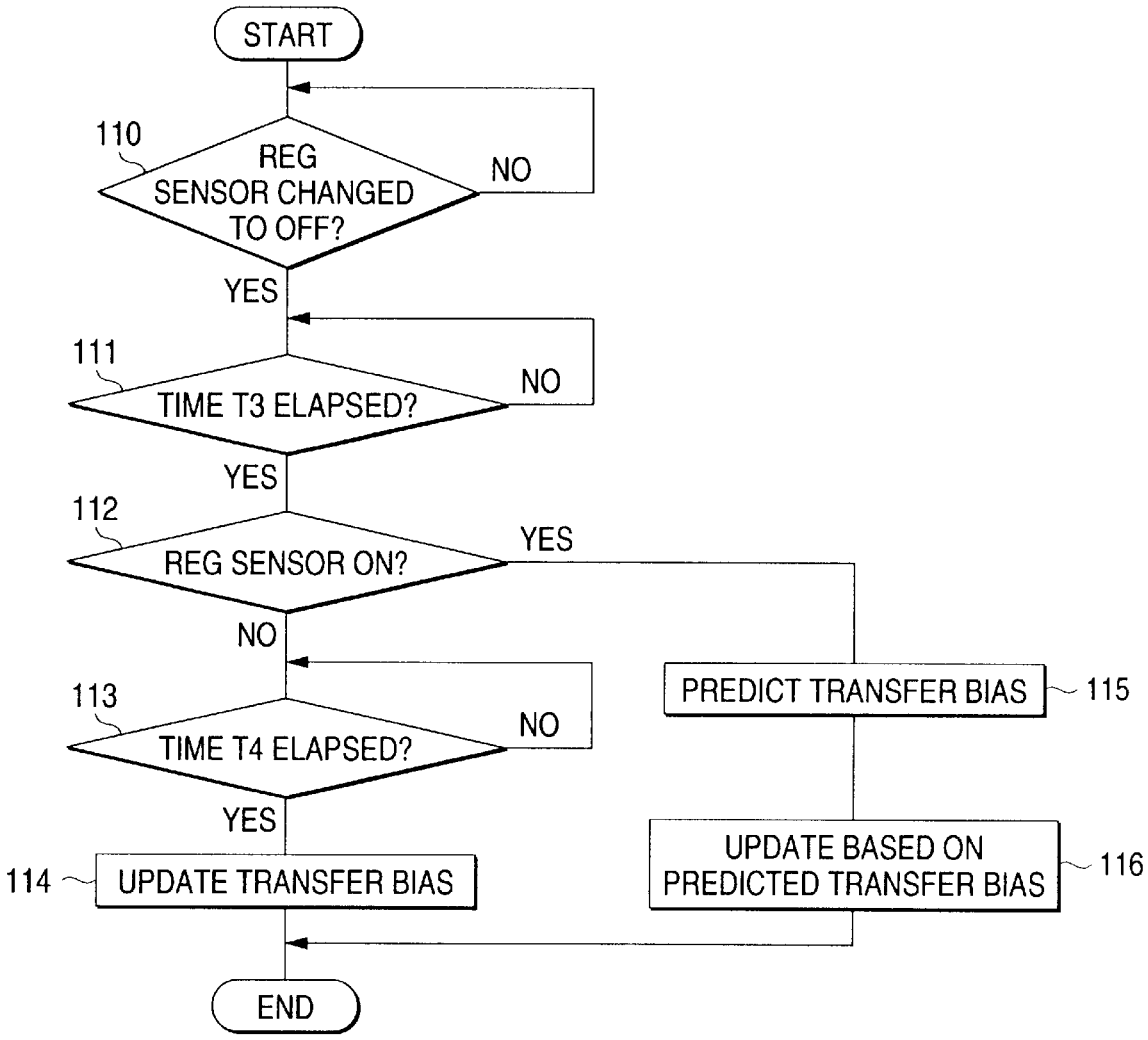
FIG. 5 is a flowchart to show another example of the transfer bias update processing in the image forming system shown in FIG. 3.

FIG. 5 is a flowchart to show detailed transfer bias update processing for predicting the transfer bias to be updated from the past transfer bias update history if a given or more page interval is not ensured and updating the transfer bias based on the predicted transfer bias.

The transfer bias update processing shown in FIG. 5 is the same as that shown in FIG. 3 except that steps 115 and 116 are added. That is, if the REG sensor 18 is determined on at step 112 shown in FIG. 3, control goes to step 115 at which the transfer bias to be updated is predicted from the past transfer bias update history. Next, at step 116, the transfer bias applied to the BTR 13 is updated based on the transfer bias predicted at step 115.

Figure 6:
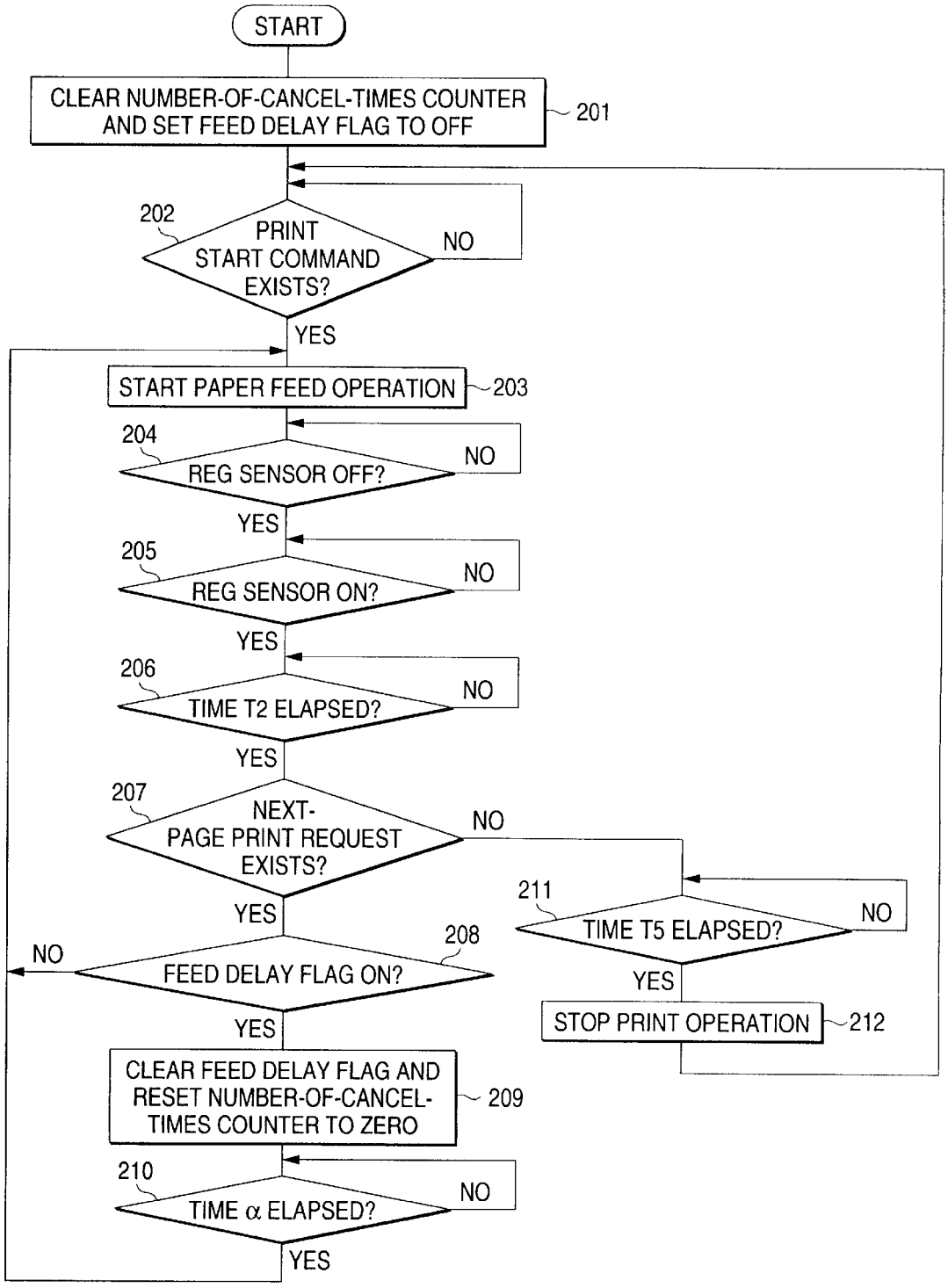
FIG. 6 is a flowchart to show details of another embodiment of paper feed processing in the image forming system shown in FIG. 1.
Figure 7:
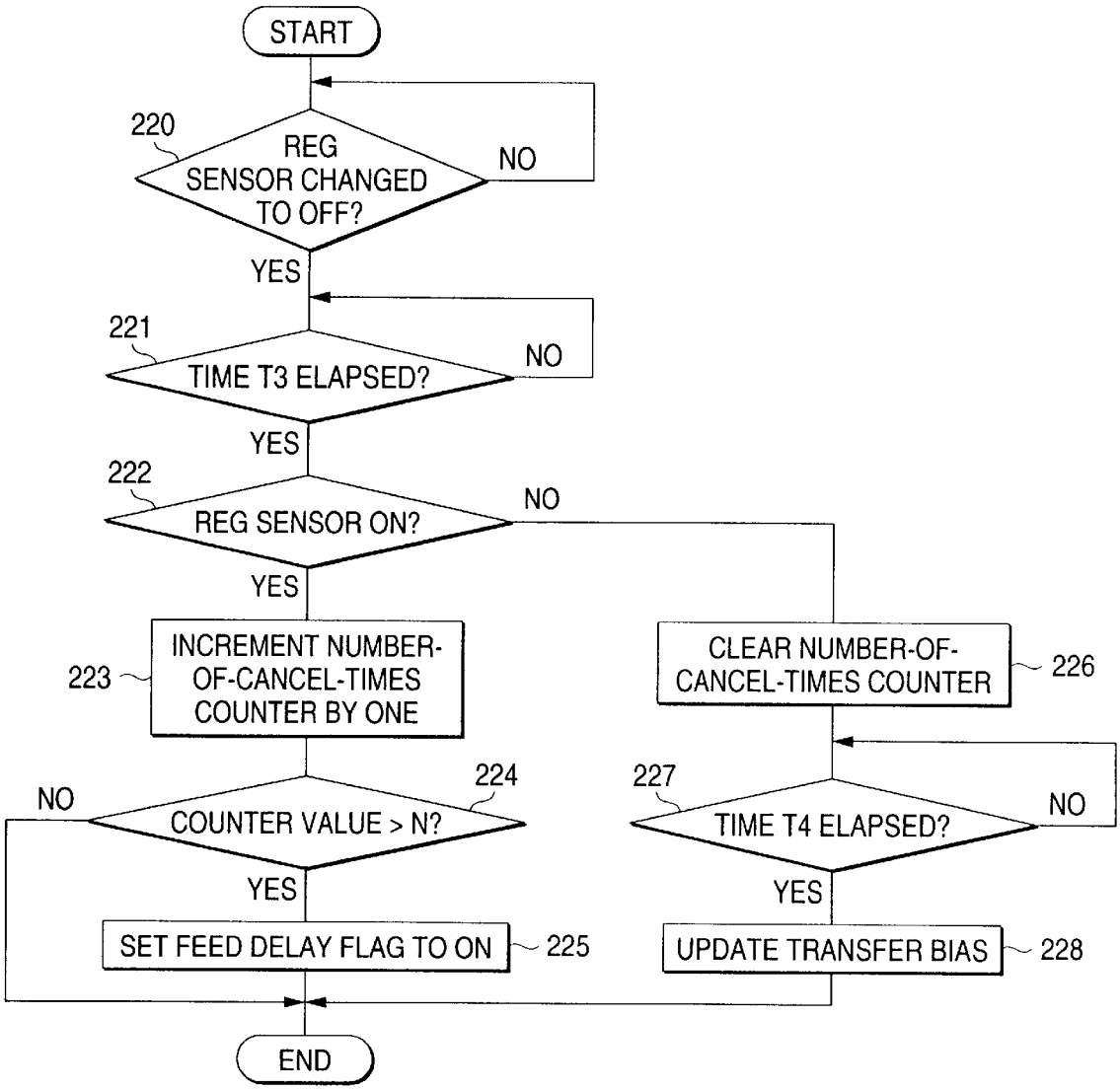
FIG. 7 is a flowchart to show details of the transfer bias update processing corresponding the paper feed processing shown in FIG. 6.

FIG. 6 is a flowchart to show details of another embodiment of paper feed processing in the image forming system shown in FIG. 1. FIG. 7 is a flowchart to show details of the transfer bias update processing corresponding the paper feed processing shown in FIG. 6.

That is, if the page interval is a given value or less, the transfer bias is not updated at that time, namely, transfer bias update is canceled as shown in FIGS. 2 and 4. If the cancel process continues at the continuous print time, updating the transfer bias responsive to change in the BTR resistance is not performed, causing the image quality to be degraded.

Then, in the embodiment, if the cancel process continues a given number of times or more, feeding the next paper is delayed, thereby widening the page interval for reliably executing resistance monitor.

According to such a configuration, resistance monitor is necessarily executed every given print and the transfer bias is updated based on the resistance monitor result. Thus, if the page interval is a given value or less and continuous print is executed, the optimum transfer bias is selected in response to change in the BTR resistance and resultantly the image quality can be prevented from being degraded.

That is, in the embodiment, a number-of-cancel-times counter for counting the number of consecutive times transfer bias update has been canceled and a feed delay flag for indicating whether or not control has been performed for delaying feeding of the next paper are provided and transfer bias update processing and feed delay processing for delaying feeding of the next paper are performed in response to the value of the number-of-cancel-times counter and the state of the feed delay flag.

In FIG. 6, first the number-of-cancel-times counter is cleared and the feed delay flag is set to off at step 201. Next, whether or not a print start command exists is checked at step 202. If it is determined at step 202 that a print start command exists, the paper feed operation for transporting paper from the paper tray 15 is started at step 203.

Whether or not the REG sensor 18 is off is checked at step 204. If the REG sensor 18 is off (YES at step 204), then whether or not the REG sensor 18 is on is checked at step 205. If the REG sensor 18 is determined on at step 205, then whether or not the time T2 has elapsed since the REG sensor 18 changed to on is checked at step 206.

As shown in FIG. 7, in the transfer bias update processing, first whether or not the REG sensor 18 has changed from on to off is checked at step 220. If it is determined at step 220 that the REG sensor 18 has changed to off, then whether or not the time T3 has elapsed since the REG sensor 18 changed to off is checked at step 221. If it is determined at step 221 that the time T3 has elapsed, control goes to step 222 at which whether or not the REG sensor 18 is on at that time is checked.

If the REG sensor 18 is determined on at step 222, control goes to step 223 at which the number-of-cancel-times counter is incremented by one. Next, whether or not the value of the number-of-cancel-times counter has exceeded a predetermined value N is checked at step 224. If it is determined at step 224 that the value of the number-of-cancel-times counter has exceeded the predetermined value N, control goes to step 225 at which the feed delay flag is set to on; if the value of the number-of-cancel-times counter is determined less than the predetermined value N (NO at step 224), the transfer bias update processing is terminated without setting the feed delay flag to on. In this case, the transfer bias is not updated and the transfer bias determined at the immediately preceding transfer time is adopted.

If it is determined at step 222 that the REG sensor 18 is not on, it can be determined that the leading end of the following paper has not arrived at the placement position of the REG sensor 18. Then, the value of the number-of-cancel-times counter is cleared at step 226. Next, whether or not the time T4 has further elapsed is checked at step 227.

If it is determined at step 227 that the time T4 has elapsed, control goes to step 228 at which the transfer bias is updated, and the processing is terminated.

On the other hand, in the processing in FIG. 6, it is determined at step 206 that the time T2 has elapsed, then whether or not a next-page print request exists is checked at step 207. If a next-page print request exists (YES at step 207), then whether or not the feed delay flag is on is checked at step 208.

If the feed delay flag is not on (NO at step 208), control returns to step 203. If the feed delay flag is on (YES at step 208), control goes to step 209 at which the flag is cleared and the value of the number-of-cancel-times counter is reset to 0. Then, whether or not predetermined delay time $\alpha$ has elapsed is checked at step 210. If the delay time a has elapsed (YES at step 210), control returns to step 203.

If it is determined at step 207 that no next-page print request exists, then whether or not the time T5 has elapsed is checked at step 211. When the time T5 has elapsed (YES at step 211), the main motor 80 is stopped for stopping the print operation at step 212 and control returns to step 202, entering a standby state for waiting for a new print command.

Figure 8:
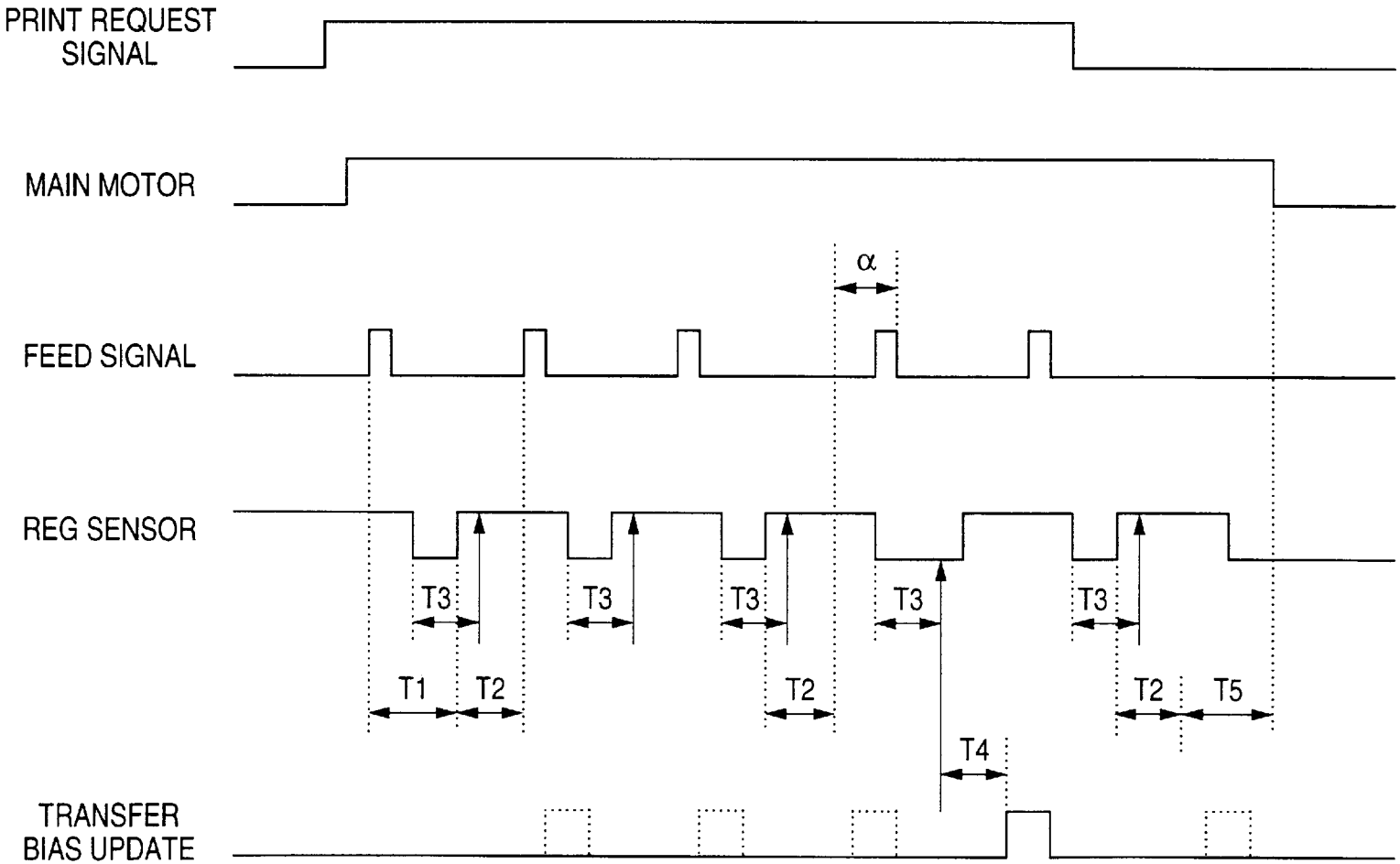
FIG. 8 is a timing chart to show the transfer bias update processing executed in the image forming system shown in FIG. 1 based on the processings shown in FIGS. 6 and 7.

FIG. 8 is a timing chart to show the transfer bias update processing executed in the image forming system shown in FIG. 1 based on the processings shown in FIGS. 6 and 7.

In FIG. 8, when a print request signal goes on, the main motor 80 is turned on. If an error such as a paper jam or the like does not occur and a predetermined interval is placed from the preceding paper, a feed signal is generated for transporting a sheet of paper using the feed roller 16 from the paper tray 15.

As the feed roller 16 rotates, transport of paper is started and the paper arrives at the REG sensor 18 in the time T1 after the feed start. If the print request signal is on in the time T2 after the REG sensor 18 is turned on, transport of the next paper is started.

The REG sensor 18 is checked for state after the time T3 has elapsed since the REG sensor 18 changed from on to off.

If the REG sensor 18 is on, it means that the following paper has already arrived at the REG sensor 18, thus it can be determined that the page interval is a given value or less. In this case, the possibility that paper may exist in the transfer nip portion at the resistance monitor signal applying timing is large, thus the transfer bias is not updated, namely, applying a resistance monitor signal to the BTR 13 for monitoring the BTR resistance is not executed and the transfer bias determined at the immediately preceding transfer time is adopted.

In contrast, if the REG sensor 18 is off when the time T3 has elapsed since the REG sensor 18 changed to off, it means that the following paper has not yet arrived at the REG sensor 18, thus it can be determined that a given or more page interval is ensured. In this case, the transfer bias is updated, namely, resistance monitor processing is performed in the time T4 and the transfer bias provided by monitoring the resistance is adopted at the next print.

However, if the state in which the transfer bias is not updated continues the predetermined number of times N or more, the next paper is not immediately fed and transport of the next paper is started with a delay of the delay time $\alpha$.

Therefore, the leading end of the following paper is delayed with respect to the trailing end of the preceding paper, so that the page interval is widened and the resistance can be monitored reliably.

In the embodiment, if a given or more page interval is not ensured, the transfer bias is not updated and the transfer bias determined at the immediately preceding transfer time is adopted. Alternatively, if a given or more page interval is not ensured, the transfer bias to be updated may be predicted from the past transfer bias update history and the transfer bias may be updated based on the predicted transfer bias.

By the way, if the configuration for delaying paper feed when the state in which the transfer bias is not updated continues the predetermined number of times N or more is introduced as in the embodiment, there is a possibility that paper feed may be delayed every given interval, and it is feared that productivity may be degraded.

At present, PPM (Print Per Minute) is used as an index representing the productivity of an image forming system and can be normally represented as 60/(T1+T2). The time T1 becomes a fixed value determined from the process speed and the distance between the tip of the paper tray 15 and the REG sensor 18. Thus, to determine the PPM so as to accomplish the target productivity, the time T2 should be set.

Assuming that paper feed is delayed by time $\alpha$ if the state in which the transfer bias is not updated continues the predetermined number of times N or more in the above configuration, the PPM worsens to $60/(T1+T2+\alpha/N)$ at the worst.

Then, to obtain the PPM fitted to the productivity target value, a configuration for setting the time T2 shorter than usual can be adopted. According to such a configuration, the target productivity can be ensured even if paper feed delay processing is performed.

Figure 9:
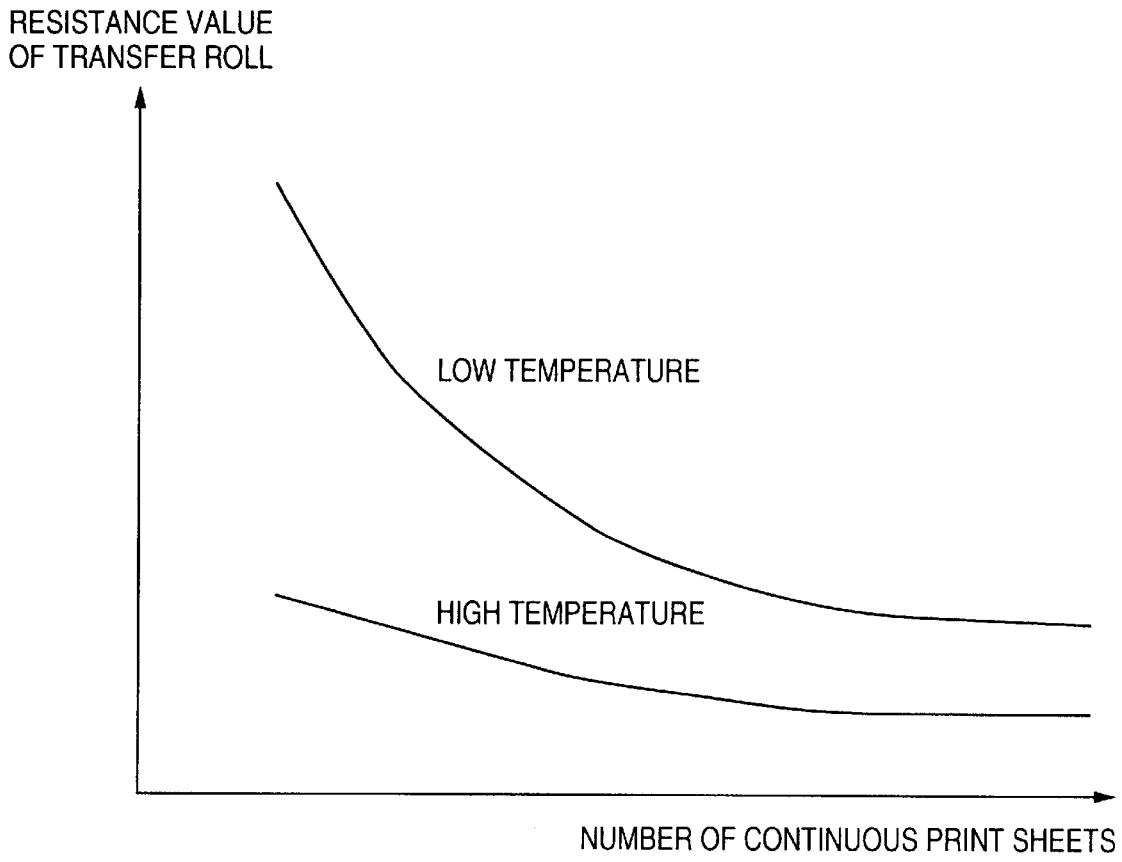
FIG. 9 is a graph to show how the resistance value of a transfer roll changes in response to the number of continuous print sheets.

The BTR resistance, namely, the resistance value of the transfer roll 13 remains low and does not much change even if continuous print is executed in a high-temperature, high-humidity environment, as shown in FIG. 9. In contrast, it is known that if continuous print is executed in a low-temperature, low-humidity environment, the BTR resistance largely changes from a very high resistance value to a low resistance value. This depends on a temperature rise in the system due to heat of the fuser 19 and the like.

Therefore, the transfer bias update frequency between pages may be low in a high-temperature environment. On the other hand, the BTR resistance changes largely in a low-temperature environment, thus it is necessary to set a high transfer bias update frequency between pages; unless a high transfer bias update frequency between pages is set, the image quality cannot be maintained good.

In an embodiment discussed below, the threshold value N of the successive number of cancel times for executing paper feed delay processing can be changed in response to the environmental temperature.

That is, when a print request signal becomes valid and print is started, the resistance monitor is executed and the optimum transfer bias is determined in response to the BTR resistance obtained based on the resistance monitor result, then is applied to the BTR 13. At the same time, the environmental temperature is determined based on the BTR resistance.

If the BTR resistance is high, the environmental temperature is determined low, and the threshold value N of the successive number of cancel times is set to a small value; if the BTR resistance is low, the environmental temperature is determined high, and the threshold value Nof the successive number of cancel times is set to a large value.

According to such a configuration, if the environmental temperature is high and the BTR resistance change is small, a low transfer bias update frequency is set, whereby the effect on the image quality can be lessened and the productivity can be improved.

If the environmental temperature is low and the BTR resistance change is large, a high transfer bias update frequency is set, whereby the transfer bias is updated finely and good image quality can be obtained.

Figure 10:
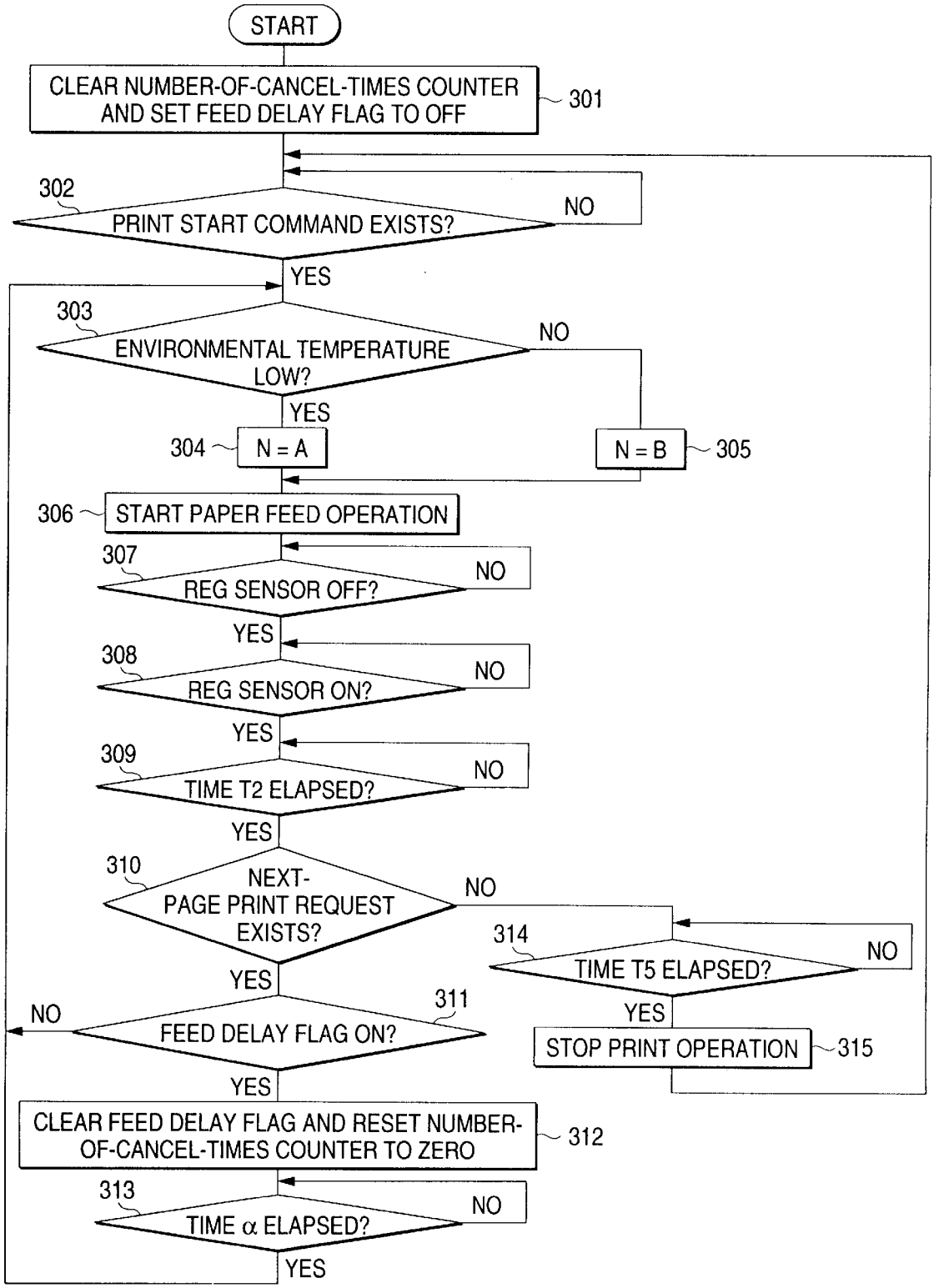
FIG. 10 is a flowchart to show details of another embodiment of paper feed processing in the image forming system shown in FIG. 1.

FIG. 10 is a flowchart to show details of another embodiment of the paper feed processing in the image forming system shown in FIG. 1 if such a configuration is adopted.

Processing in the flowchart shown in FIG. 10 is the same as that in the flowchart shown in FIG. 6 except that a process is added for determining whether the environmental temperature is low or high after step 202 in FIG. 6 for determining whether or not a print start command exists in the flowchart previously described with reference to FIG. 6 and setting the threshold value N of the successive number of cancel times to A or B in response to the determination result.

That is, first the number-of-cancel-times counter is cleared and the feed delay flag is set to off at step 301. Next, whether or not a print start command exists is checked at step 302. If it is determined at step 302 that a print start command exists, then whether or not the environmental temperature is low is checked at step 303.

Whether or not the environmental temperature is low can be determined based on the BTR resistance obtained according to the result of the resistance monitor executed when the print request signal becomes valid as described above.

If the environmental temperature is determined low (YES at step 303), the threshold value N of the successive number of cancel times is set to A at step 304. If the environmental temperature is determined high (NO at step 303), the threshold value N of the successive number of cancel times is set to B (B>A) at step 305.

Next, the paper feed operation for transporting paper from the paper tray 15 is started at step 306. Whether or not the REG sensor 18 is off is checked at step 307. If the REG sensor 18 is off (YES at step 307), then whether or not the REG sensor 18 is on is checked at step 308. If the REG sensor 18 is determined on at step 308, then whether or not the time T2 has elapsed since the REG sensor 18 changed to on is checked at step 309.

If it is determined at step 308 that the time T2 has elapsed, then whether or not a next-page print request exists is checked at step 310. If a next-page print request exists (YES at step 310), then whether or not the feed delay flag is on is checked at step 311.

If the feed delay flag is not on (NO at step 311), control returns to step 303. If the feed delay flag is on (YES at step 311), control goes to step 312 at which the flag is cleared and the value of the number-of-cancel-times counter is reset to 0. Then, whether or not predetermined delay time α has elapsed is checked at step 313. If the delay time α has elapsed (YES at step 313), control returns to step 303.

If it is determined at step 310 that no next-page print request exists, then whether or not the time T5 has elapsed is checked at step 314. When the time T5 has elapsed (YES at step 314), the main motor 80 is stopped for stopping the print operation at step 315 and control returns to step 302, entering a standby state for waiting for a new print command.

For the transfer bias update processing in this case, processing similar to the transfer bias update processing shown in FIG. 7 can be adopted.

As seen from the relationship between the BTR resistance shown in FIG. 9, namely, the resistance value of the transfer roll 13 and the number of continuous print sheets, the BTR resistance change lessens as the number of continuous print sheets increases.

Therefore, if the number of continuous print sheets increases, the image quality is not affected even if the transfer bias update frequency between pages is lowered.

Then, the system can be configured so as to set the threshold value N of the successive number of cancel times to a large value if the number of continuous print sheets exceeds one value.

According to such a configuration, degradation of the productivity can be minimized while the image quality is maintained good. The processing may be adopted only if the environmental temperature is determined low, or may be adopted independently of the determination of the environmental temperature. Further, the number of continuous print sheets applied for setting the threshold value Nof the successive number of cancel times to a large value may be changed depending on the determined environmental temperature.

In this type of image forming system, cancel processing can be executed due to variations on manufacturing, print environment, and paper quality even if the page-to-page interval is extended by the delay time α.

To cope with this problem, the system can be configured so as to prolong the delay time α in response to the number of times by which the cancel processing has been executed successively.

According to such a configuration, the transfer bias update processing between pages can be executed reliably by the above-mentioned delay processing. If a readable and writable nonvolatile memory 70 is used, the delay time set by the delay processing can be stored in the nonvolatile memory 70, whereby the optimum delay time executed so far can be applied without executing the paper feed delay processing many times for gradually extending the page-to-page interval, so that degradation of the productivity can be prevented.

If the number of sheets used for feed delay determination is stored in the nonvolatile memory 70, the optimum delay time can also be set later in response to the environment in which the image forming system is installed.

For example, if it is obvious that no print is executed in a low-temperature or high-temperature environment or it is desirable to prevent the speed from lowering rather than degradation of the image quality, the user can set the optimum delay time later by rewriting the contents of the nonvolatile memory 70.

To prevent the speed from lowering, if effectiveness/ineffectiveness of page-to-page processing function is stored in the nonvolatile memory 70, it is made possible to print without operating the processing function.

When cancel processing is executed, the REG sensor 18 is turned off and on within the time T3. Then, if the off-time and on-time of the REG sensor 18 are stored, the time for which the REG sensor 18 is off can be found by subtracting the off-time from the on-time. If the delay time α is a fixed value, when it is small, it is feared that cancel processing may be performed although the paper feed is delayed; when the delay time α is large, it is feared that the productivity may be degraded.

Then, to delay the paper feed, the delay time α is determined by calculating (stipulated time between pages) minus (time for which the REG sensor is off) plus (margin). In doing so, the optimum feed delay time can be determined automatically.

To determine the delay time according to this method, it is desirable to store the times for which the REG sensor 18 is off for several sheets of paper just before and average the times for decreasing variations.

Figure 11:
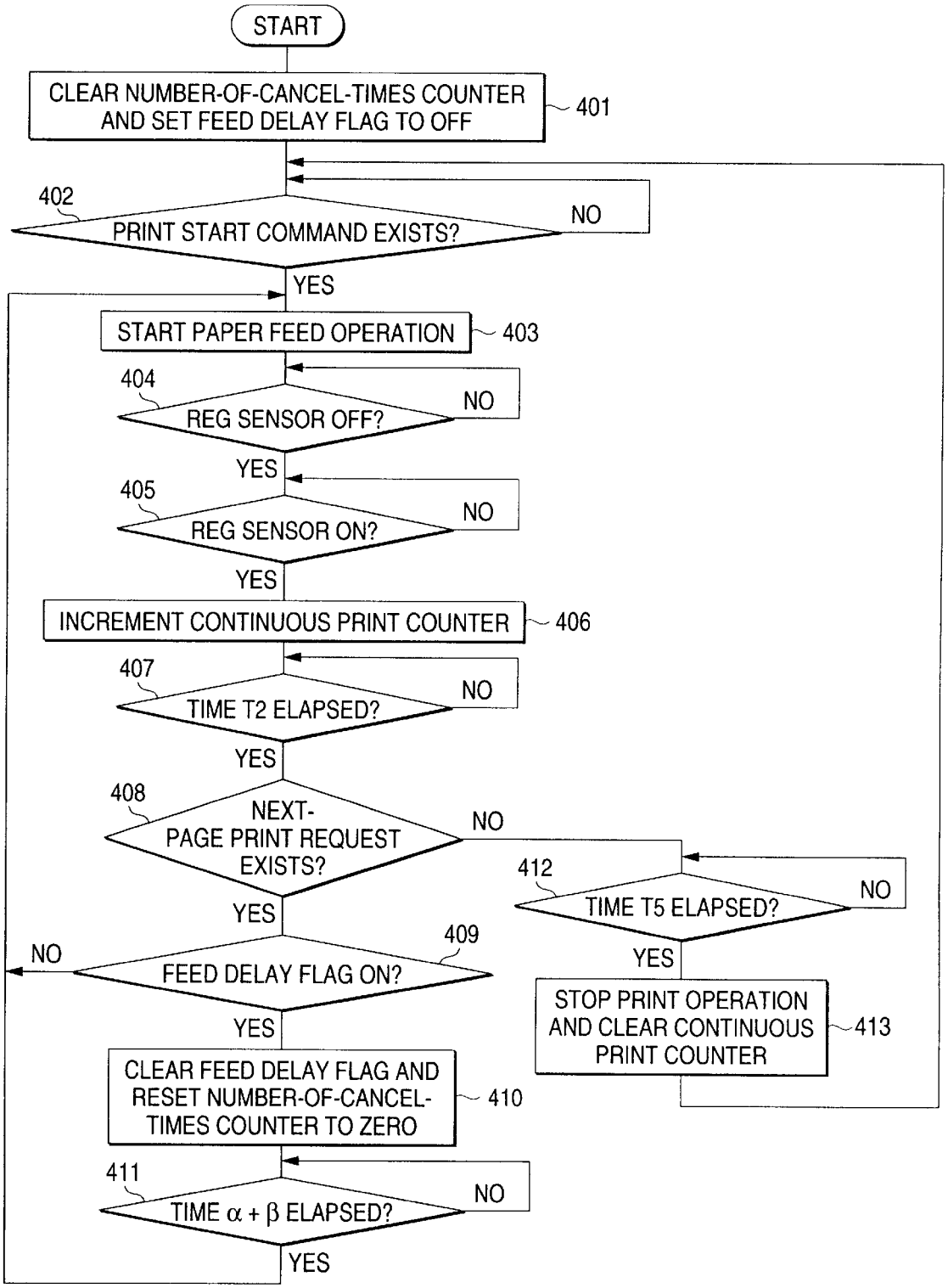
FIG. 11 is a flowchart to show details of still another embodiment of paper feed processing in the image forming system shown in FIG. 1.
Figure 12:
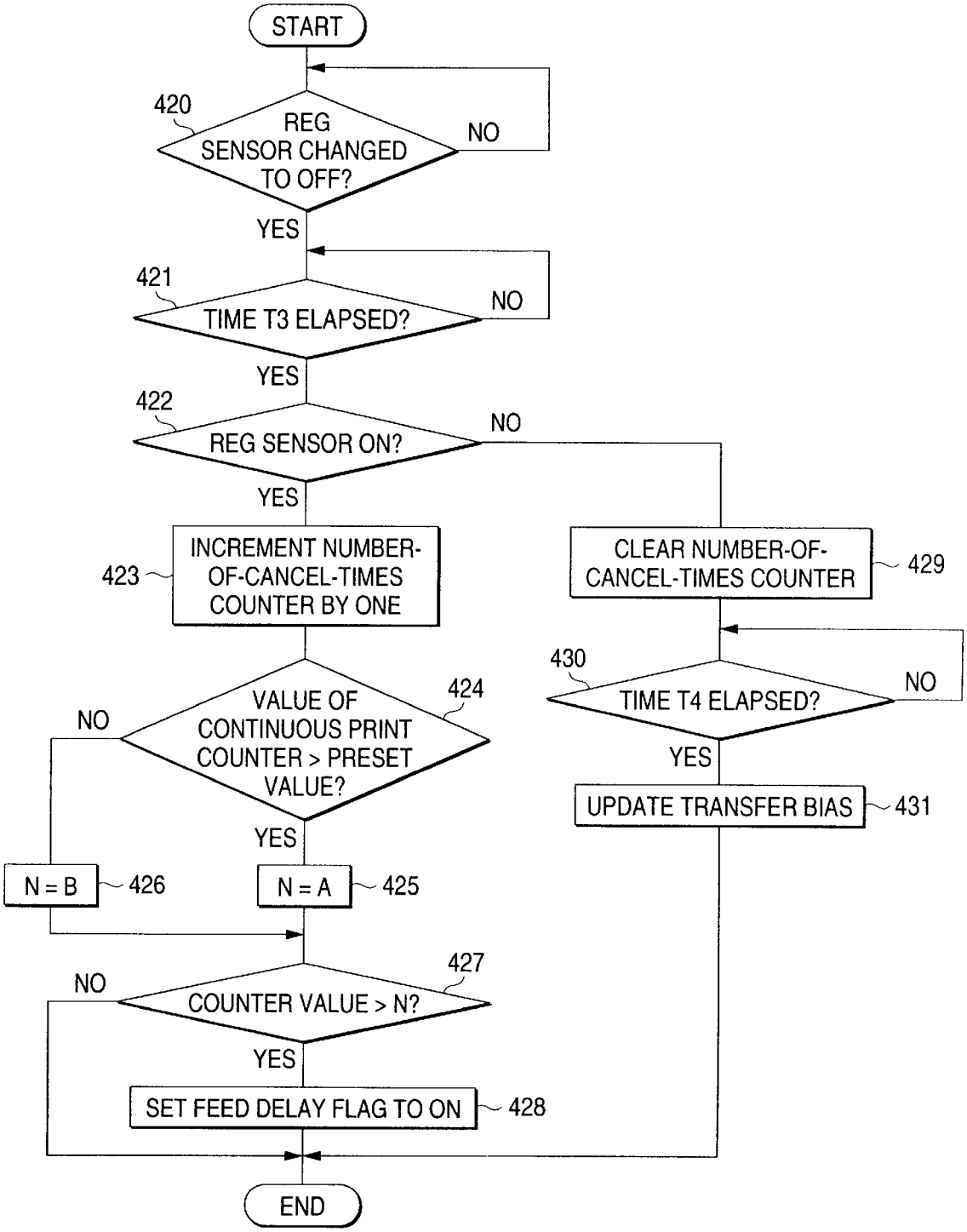
FIG. 12 is a flowchart to show details of the transfer bias update processing corresponding the paper feed processing shown in FIG. 11.

FIGS. 11 and 12 are flowcharts to show details of another embodiment wherein the delay time is extended gradually in response to the number of times by which the cancel processing has been executed successively, whereby the transfer bias update between pages can be executed reliably.

FIG. 11 shows details of the paper feed processing in the embodiment. Processing in the flowchart shown in FIG. 11 is the same as that in the flowchart shown in FIG. 6 except that a step for incrementing a continuous print counter for counting the number of continuous print sheets is added after the REG sensor 18 is turned on (YES at step 205 in FIG. 6), except that step 210 in FIG. 6 for determining whether or not the time α has elapsed is replaced with a step for determining whether or not the time a plus time β changed (increased) in response to the value of the continuous print counter has elapsed, and except that clearing the continuous print counter is added to step 212 in FIG. 6 for stopping the print operation.

That is, first the number-of-cancel-times counter is cleared and the feed delay flag is set to off at step 401. Next, whether or not a print start command exists is checked at step 402. If it is determined at step 402 that a print start command exists, the paper feed operation for transporting paper from the paper tray 15 is started at step 403.

Next, whether or not the REG sensor 18 is off is checked at step 404. If the REG sensor 18 is off (YES at step 404), then whether or not the REG sensor 18 is on is checked at step 405. If the REG sensor 18 is determined on at step 405, then the value of the continuous print counter is incremented at step 406.

Next, whether or not the time T2 has elapsed since the REG sensor 18 changed to on is checked at step 407.

If it is determined at step 407 that the time T2 has elapsed, then whether or not a next-page print request exists is checked at step 408. If a next-page print request exists (YES at step 408), then whether or not the feed delay flag is on is checked at step 409.

If the feed delay flag is not on (NO at step 409), control returns to step 403. If the feed delay flag is on (YES at step 409), control goes to step 410 at which the flag is cleared and the value of the number-of-cancel-times counter is reset to 0.

Then, whether or not the predetermined delay time α plus the time β changed in response to the value of the continuous print counter, namely, the time α+β has elapsed is checked at step 411. If the time α+β has not yet elapsed (NO at step 411), a wait is made at step 411 until the time α+β elapses. If it is determined at step 411 that the time αa+β has elapsed, control returns to step 403.

If it is determined at step 408 that no next-page print request exists, then whether or not the time T5 has elapsed is checked at step 412. When the time T5 has elapsed (YES at step 412), the main motor 80 is stopped for stopping the print operation and the continuous print counter is cleared at step 413 and control returns to step 402, entering a standby state for waiting for a new print command.

FIG. 12 is a flowchart to show details of the transfer bias update processing in the embodiment.

Processing in the flowchart shown in FIG. 12 is the same as that in the flowchart shown in FIG. 7 except that a process for determining whether or not the value of the continuous print counter exceeds a preset value and setting the threshold value N of the successive number of cancel times to A or B in response to the determination result is added after step 223 in FIG. 7 for incrementing the number-of-cancel-times counter.

That is, first whether or not the REG sensor 18 has changed from on to off is checked at step 420. If it is determined at step 420 that the REG sensor 18 has changed to off, then whether or not the time T3 has elapsed since the REG sensor 18 changed to off is checked at step 421. If it is determined at step 421 that the time T3 has elapsed, control goes to step 422 at which whether or not the REG sensor 18 is on at that time is checked.

If the REG sensor 18 is determined on at step 422, control goes to step 423 at which the number-of-cancel-times counter is incremented by one. Next, whether or not the value of the continuous print counter has exceeded the preset value is checked at step 424. If the value of the continuous print counter has exceeded the preset value (YES at step 424), the threshold value N of the successive number of cancel times is set to A at step 425. If the value of the continuous print counter has not exceeded the preset value (NO at step 424), the threshold value N of the successive number of cancel times is set to B (B>A) at step 426.

Next, whether or not the value of the number-of-cancel-times counter has exceeded the predetermined value N is checked at step 427. If it is determined at step 427 that the value of the number-of-cancel-times counter has exceeded the predetermined value N, control goes to step 428 at which the feed delay flag is set to on; if the value of the number-of-cancel-times counter has not exceeded the predetermined value N (NO at step 427), the transfer bias update processing is terminated without setting the feed delay flag to on. In this case, the transfer bias is not updated and the transfer bias determined at the immediately preceding transfer time is adopted.

If it is determined at step 422 that the REG sensor 18 is not on, it can be determined that the leading end of the following paper has not arrived at the placement position of the REG sensor 18. Then, the value of the number-of-cancel-times counter is cleared at step 429. Whether or not the time T4 has further elapsed is checked at step 430. If it is determined at step 430 that the time T4 has elapsed, control goes to step 431 at which the transfer bias is updated, and the processing is terminated.

By the way, when the BTR resistance is a given value or less (the resistance at the 1000 V applying time is about 8.0 log Ω or less), the surface potential of the photosensitive drum 10 remarkably drops because of the effect of transfer current at the portion where the BTR 13 is in direct contact with the photosensitive drum 10 in the vicinity of both ends of paper, the roll charger 11 cannot sufficiently charge the photosensitive drum 10 to a stipulated surface potential, and transfer memory may occur. Particularly, at the second-side transfer time, the applied transfer voltage becomes larger than at the first-side transfer time, thus occurrence of transfer memory becomes noticeable.

To solve this problem, the page interval at the continuous print time can be widened more than one round of the photosensitive drum to sufficiently charge the photosensitive drum 10 by the roll charger 11.

According to such a configuration, it is made possible to sufficiently charge the photosensitive drum 10; resultantly, transfer memory can be erased, so that side dirt caused by the transfer memory can be prevented.

As described above, according to the invention, in the image forming system wherein a predetermined monitor signal is applied to the transfer means for estimating a resistance value of the transfer means between one transfer material passing through the contact portion between the image carrier and the transfer means and the next transfer material being introduced into the contact portion and the transfer bias applied to the transfer means is updated in response to the estimated resistance value, if the time between one transfer material passing through the contact portion and the next transfer material being introduced into the contact portion is less than a predetermined time, updating of the transfer bias is inhibited, and further if updating of the transfer bias is inhibited successively a predetermined threshold value of the number of times or more, introduction of the next transfer material is delayed a predetermined time. Thus, the transfer bias can be properly controlled based on estimation of the resistance value of the transfer means, so that a high-quality image with no transfer image quality failure can be formed.

What is claimed is:

1. An image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, wherein a predetermined monitor signal is applied to said transfer means for estimating a resistance value of said transfer means between one transfer material passing through the contact portion and a next transfer material being introduced into the contact portion and the transfer bias is updated in response to the estimated resistance value, said image forming system comprising:

transfer bias control means for inhibiting updating of the transfer bias if a time between the one transfer material passing through the contact portion and the next transfer material being introduced into the contact portion is less than a predetermined time.

2. The image forming system as claimed in claim 1, wherein if said time between the one transfer material passing through the contact portion and the next transfer material being introduced into the contact portion is less than said predetermined time, said transfer bias control means holds the transfer bias to its current value.

3. The image forming system as claimed in claim 1, wherein if said time between the one transfer material passing through the contact portion and the next transfer material being introduced into the contact portion is less than said predetermined time, said transfer bias control means estimates the value of the transfer bias based on a past updating control of the transfer bias and updates the transfer bias to the estimated value.

4. An image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, wherein a predetermined monitor signal is applied to said transfer means for estimating a resistance value of said transfer means between one transfer material passing through the contact portion and a next transfer material being introduced into the contact portion and the transfer bias is updated in response to the estimated resistance value, said image forming system comprising:

transfer bias control means for inhibiting updating of the transfer bias if a time between the one transfer material passing through the contact portion and the next transfer material being introduced into the contact portion is less than a first predetermined time; and delay means for delaying introduction of the next transfer material a second predetermined time if said transfer bias control means successively inhibits updating of the transfer bias a predetermined threshold value of the number of times or more.

5. The image forming system as claimed in claim 4, wherein if said time between the one transfer material passing through the contact portion and the next transfer material being introduced into the contact portion is less than said first predetermined time said transfer bias control means holds the transfer bias to its current value.

6. The image forming system as claimed in claim 4, wherein if said time between the one transfer material passing through the contact portion and the next transfer material being introduced into the contact portion is less than said first predetermined time, said transfer bias control means estimates the value of the transfer bias based on a past updating control of the transfer bias and updates the transfer bias to the estimated value.

7. The image forming system as claimed in claim 4, wherein said delay means changes the threshold value of the number of times in response to the estimated resistance value of said transfer means.

8. The image forming system as claimed in claim 4, wherein said delay means changes the threshold value of the number of times in response to the successive number of transfer times to the transfer material.

9. The image forming system as claimed in claim 4, wherein said delay means changes the threshold value of the number of times in response to an environmental temperature.

10. The image forming system as claimed in claim 4, wherein said delay means stores the past estimated resistance values of said transfer means and adaptively changes the threshold value of the number of times in response to change in the estimated resistance value of said transfer means based on the stored values.

11. The image forming system as claimed in claim 4, wherein said delay means gradually increases the delay time in response to the number of times by which said transfer bias control means has updated the transfer bias successively.

12. The image forming system as claimed in claim 4, wherein said delay means stores in a learning manner the updating control result of said transfer bias control means corresponding to a predetermined-time delay control and adaptively determines a minimum delay time based on the stored control result.

13. An image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, wherein a predetermined monitor signal is applied to said transfer means for estimating a resistance value of said transfer means between one transfer material passing through the contact portion and a next transfer material being introduced into the contact portion and the transfer bias is updated in response to the estimated resistance value, said image forming system comprising:

transfer bias control means for inhibiting updating of the transfer bias if a time between the one transfer material passing through the contact portion and the next transfer material being introduced into the contact portion is less than a predetermined time; and delay means for delaying introduction of the next transfer material until said image carrier makes at least one round if the estimated resistance value of said transfer means is equal to or less than a preset value.

14. A method for controlling an image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, said method comprising the steps of:

applying a predetermined monitor signal to said transfer means for estimating a resistance value of said transfer means between one transfer material passing through the contact portion and a next transfer material being introduced into the contact portion;

updating the transfer bias in response to the estimated resistance value; and inhibiting updating of the transfer bias if a time between the one transfer material passing through the contact portion and the next transfer material being introduced into the contact portion is less than a predetermined time.

15. The method as claimed in claim 14, wherein if said time between the one transfer material passing through the contact portion and the next transfer material being introduced into the contact portion is less than said predetermined time, the transfer bias is held to its current value.

16. The method as claimed in claim 14, wherein if said time between the one transfer material passing through the contact portion and the next transfer material being introduced into the contact portion is less than said predetermined time, the transfer bias is estimated based on a past updating control of the transfer bias and is updated to the estimated value.

17. A method for controlling an image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, said method comprising the steps of:

applying a predetermined monitor signal to said transfer means for estimating a resistance value of said transfer means between one transfer material passing through the contact portion and a next transfer material being introduced into the contact portion;

updating the transfer bias in response to the estimated resistance value;

inhibiting updating of the transfer bias if a time between the one transfer material passing through the contact portion and the next transfer material being introduced into the contact portion is less than a first predetermined time; and delaying introduction of the next transfer material a second predetermined time if updating of the transfer bias has been inhibited successively a predetermined threshold value of the number of times or more.

18. The method as claimed in claim 17, wherein if said time between the one transfer material passing through the contact portion and the next transfer material being introduced into the contact portion is less than said first predetermined time, the transfer bias is held to its current value.

19. The method as claimed in claim 17, wherein if said time between the one transfer material passing through the contact portion and the next transfer material being introduced into the contact portion is less than said first predetermined time, the transfer bias is estimated based on a past updating control of the transfer bias and is updated to the estimated value.

20. The method as claimed in claim 17, wherein the threshold value of the number of times is changed in response to the estimated resistance value of said transfer means.

21. The method as claimed in claim 17, wherein the threshold value of the number of times is changed in response to the successive number of transfer times to the transfer material.

22. The method as claimed in claim 17, wherein the threshold value of the number of times is changed in response to an environmental temperature.

23. The method as claimed in claim 17, wherein past estimated resistance values of said transfer means are stored and the threshold value of the number of times is adaptively changed in response to change in the estimated resistance value of said transfer means based on the stored values.

24. The method as claimed in claim 17, wherein the delay time is gradually increased in response to the number of times by which updating of the transfer bias has been executed successively.

25. The method as claimed in claim 17, wherein the transfer bias updating control result corresponding to a predetermined-time delay control is stored in a learning manner and a minimum delay time is adaptively determined based on the stored control result.

26. A method for controlling an image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, said method comprising the steps of:

applying a predetermined monitor signal to said transfer means for estimating a resistance value of said transfer means between one transfer material passing through the contact portion and a next transfer material being introduced into the contact portion;

updating the transfer bias in response to the estimated resistance value;

inhibiting updating of the transfer bias if a time between the one transfer material passing through the contact portion and the next transfer material being introduced into the contact portion is less than a predetermined time; and delaying introduction of the next transfer material until said image carrier makes at least one round if the estimated resistance value of said transfer means is equal to or less than a preset value.

27. An image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, wherein a predetermined monitor signal is applied to said transfer means for estimating a resistance value of said transfer means between one transfer material passing through the contact portion and a next transfer material being introduced into the contact portion and the transfer bias is updated in response to the estimated resistance value, said image forming system comprising:

transfer bias control means for estimating the transfer bias if a time between the one transfer material passing through the contact portion and the next transfer material being introduced into the contact portion is less than a predetermined time.

28. The image forming system as claimed in claim 27, wherein if said time between the one transfer material passing through the contact portion and the next transfer material being introduced into the contact portion is less than said predetermined time, said transfer bias control means estimates a transfer bias value based on a past updating control of the transfer bias and updates the transfer bias to the estimated value.

29. An image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, wherein a predetermined monitor signal is applied to said transfer means for estimating a resistance value of said transfer means between one transfer material passing through the contact portion and a next transfer material being introduced into the contact portion and the transfer bias is updated in response to the estimated resistance value, said image forming system comprising:

transfer bias control means for estimating the transfer bias if a time between the one transfer material passing through the contact portion and the next transfer material being introduced into the contact portion is less than a first predetermined time; and delay means for delaying introduction of the next transfer material a second predetermined time if said transfer bias control means successively estimates the transfer bias a predetermined threshold value of the number of times or more.

30. The image forming system as claimed in claim 29, wherein if said time between the one transfer material passing through the contact portion and the next transfer material being introduced into the contact portion is less than said first predetermined time, said transfer bias control means estimates the transfer bias based on a past updating control of the transfer bias and updates the transfer bias to the estimated value.

31. A method for controlling an image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, said method comprising the steps of:

applying a predetermined monitor signal to said transfer means for estimating a resistance value of said transfer means between one transfer material passing through the contact portion and a next transfer material being introduced into the contact portion;

updating the transfer bias in response to the estimated resistance value; and estimating the transfer bias if a time between the one transfer material passing through the contact portion and the next transfer material being introduced into the contact portion is less than a predetermined time.

32. The method as claimed in claim 31, wherein if said time between the one transfer material passing through the contact portion and the next transfer material being introduced into the contact portion is less than said predetermined time, said transfer bias control means estimates the transfer bias based on a past updating control of the transfer bias and updates the transfer bias to the estimated value.

33. A method for controlling an image forming system having an image carrier for carrying a transfer image and transfer means to which a predetermined transfer bias is applied for sequentially introducing a transfer material into a contact portion between said image carrier and said transfer means and allowing the transfer material to pass therethrough, thereby sequentially transferring the transfer image to the transfer material, said method comprising the steps of:

applying a predetermined monitor signal to said transfer means for estimating a resistance value of said transfer means between one transfer material passing through the contact portion and a next transfer material being introduced into the contact portion;

updating the transfer bias in response to the estimated resistance value;

estimating the transfer bias if a time between the one transfer material passing through the contact portion and the next transfer material being introduced into the contact portion is less than a first predetermined time; and delaying introduction of the next transfer material a second predetermined time if the transfer bias has been estimated successively a predetermined threshold value of the number of times or more.

34. The method as claimed in claim 33, wherein if said time between the one transfer material passing through the contact portion and the next transfer material being introduced into the contact portion is less than said first predetermined time, said transfer bias control means estimates the transfer bias based on a past updating control of the transfer bias and updates the transfer bias to the estimated value.

* * * * *